US007435890B2

(12) United States Patent
Yamada

(10) Patent No.: US 7,435,890 B2
(45) Date of Patent: Oct. 14, 2008

(54) TUNING DEVICE AND METHOD FOR MUSICAL INSTRUMENT

(75) Inventor: Yasuyuki Yamada, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 11/398,797

(22) Filed: Apr. 6, 2006

(65) Prior Publication Data

US 2006/0236849 A1 Oct. 26, 2006

(30) Foreign Application Priority Data

Apr. 20, 2005 (JP) ..... 2005-121989

(51) Int. Cl.
*G10G 7/02* (2006.01)

(52) U.S. Cl. ..... 84/454; 84/DIG. 18; 116/284; 116/297; 984/140; 984/260

(58) Field of Classification Search ..... 84/454, 84/DIG. 18; 116/204, 284, 288, 291, 296, 116/297; 984/140, 260
See application file for complete search history.

(56) References Cited

U.S. PATENT DOCUMENTS 4,120,229 A * 10/1978 Ota ..... 84/454
5,274,614 A * 12/1993 Yamazaki ..... 368/28
5,374,775 A * 12/1994 Kawamura et al. ..... 84/615
5,877,443 A * 3/1999 Arends et al. ..... 84/454
6,470,822 B2 * 10/2002 Adams et al. ..... 116/284
6,717,330 B2 * 4/2004 Iino et al. ..... 310/317
2005/0024008 A1 * 2/2005 Yamada ..... 318/685

FOREIGN PATENT DOCUMENTS

JP 3231362 9/2001

* cited by examiner

*Primary Examiner*—Lincoln Donovan
*Assistant Examiner*—Andrew R Millikin
(74) *Attorney, Agent, or Firm*—Foley & Lardner LLP

(57) ABSTRACT

A tuning device includes a pitch extraction device with which the pitch of an input signal is extracted and a deviation detection device with which the deviation of the pitch that has been extracted by the pitch extraction device from a standard pitch is detected. The deviation that has been detected by the deviation detection device is displayed by an indicator of a mechanical meter. The tuning device also includes an ultrasonic motor that drives the indicator. A controller drives the ultrasonic motor in conformance with the deviation that has been detected by the deviation detection device. The controller, by driving the indicator using the ultrasonic motor, arranges the indicator in the standard position in those cases where the deviation that has been detected by the deviation detection device is zero, and moves the indicator up to a position in the positive direction that corresponds to the deviation in those cases where the deviation is a positive value and moves the indicator up to a position in the negative direction that corresponds to the deviation in those cases where the deviation is a negative value.

37 Claims, 3 Drawing Sheets

TUNING DEVICE AND METHOD FOR MUSICAL INSTRUMENT

CROSS-REFERENCE TO RELATED PATENT APPLICATIONS

Japan Priority Application 2005-121989, filed Apr. 20, 2005 including the specification, drawings, claims and abstract, is incorporated herein by reference in its entirety.

BACKGROUND OF THE INVENTION

1. Field of the Invention

Embodiments of the present invention relate to a tuning device and method with which the tuning of a musical instrument such as a guitar or a wind instrument and the like is carried out and, in particular, to a tuning device that has a mechanical meter.

2. Related Art

In conventional tuning devices for musical instruments, the meter section which shows the deviation of the pitch of an input signal from a standard pitch, typically includes display meters. Such meters carry out the display of the deviation by a display using light emitting diode (LED)s or liquid crystal displays (LCD)s as well as mechanical meters that carry out the display of the deviation using the movement of an indicator and the like.

Tuning devices in which the meter section is configured with a meter that uses LEDs or LCDs can be created inexpensively. Because the display of the deviation is in steps, in other words, not continuous, however, there is a weakness that fine tuning under conditions in which the pitch of the input signal approaches the standard pitch is difficult to carry out and the device is difficult to use.

In that regard, a tuning device in which the meter section has been configured with a mechanical meter such as, for example, that cited in Japanese Patent Publication No. 3,231,362 is expensive, but since the display of the deviation changes continuously, tuning is carried out easily and this meter section is in high demand.

However, with a mechanical meter such as the one described in Japanese Patent Publication No. 3,231,362, the meter has advantages such as those described above. However, because the driving of the indicator is carried out by the repulsive force of a spring and the magnetic force of an electromagnet, there have been various kinds of problems that accompany the use of the spring and the electromagnet (coil and magnet) with the mechanical meter.

Specifically, one problem that arises is that because over time a deterioration of the spring is produced and as a matter of course, a chronological display error is generated and compared to a meter that uses LEDs or LCDs, the life of the mechanical meter is short. In addition, other problem areas include the fact that since an electromagnet is used, the meter is likely to be affected by the magnetic forces in the surroundings and, for example, in the vicinity of devices that generate magnetic forces such as the speaker of a guitar amplifier and or a guitar pickup. As such, accurate tuning cannot be carried out and the places that the device can be used are limited. Also, since the movement of the indicator, which has a weak retention torque, is affected by the force of gravity, there have been problems such as the fact that items that are to be placed vertically cannot be placed horizontally and both the direction of placement and the angle of placement are limited.

In addition, because the wiring to the electromagnet with which the indicator is driven is placed in the vicinity of the indicator, there has been the problem that failures are likely to occur in the wiring together with the driving of the indicator. Also, since an electromagnet is used to drive the indicator, power consumption is great and, as a result, there has been the problem that in those cases where a mechanical meter is employed in a tuning device for portable use. In portable devices, batteries are typically used for the power source, and the operating time for a mechanical meter is short compared to a meter that uses LEDs or LCDs.

In addition, there have been problems such as the fact that since variations are likely to occur between individual meters and in order to absorb these variations, the use of a semi-fixed resistor and the like is provided capable of performing fine adjustments. Also, it is necessary to carry out the adjustments at the time of shipping, making the processes at the time of manufacture complicated.

Furthermore, since a coil and a magnet are installed as items that are fundamental to the spring and the electromagnet, there has been the problem that there is a limit to miniaturization of the mechanical meter and to making the mechanical meter thin.

SUMMARY OF THE DISCLOSURE

Embodiments of the present invention address the problems described above and relate to a tuning device with which certain limitations of the mechanical meters of the past have been eliminated.

According to one embodiment of the present invention, a tuning device includes a pitch extraction device with which the pitch of an input signal is extracted and a deviation detection device with which the deviation of the pitch that has been extracted by the pitch extraction device from a standard pitch is detected. The deviation that has been detected by the deviation detection device is displayed by an indicator of a mechanical meter. The tuning device also includes an ultrasonic motor that drives the indicator. A controller drives the ultrasonic motor in conformance with the deviation that has been detected by the deviation detection device. The controller, by driving the indicator using the ultrasonic motor, arranges the indicator in the standard position in those cases where the deviation that has been detected by the deviation detection device is zero, and moves the indicator up to a position in the positive direction that corresponds to the deviation in those cases where the deviation is a positive value and moves the indicator up to a position in the negative direction that corresponds to the deviation in those cases where the deviation is a negative value.

According to an example embodiment of the present invention, the tuning device further includes a position detection device with which the position information of the indicator is detected, and the control device drives the ultrasonic motor based on the position information of the indicator that has been detected by the position detection device and the deviation.

With respect to the position detection device, the indicator position information is detected in the range in which the indicator moves. Also, the position detection device detects the position information that indicates the fact that the indicator is arranged at the standard position. Further, the indicator is made in a single unit with the rotating section of the ultrasonic motor.

According to another example embodiment of the present invention, the tuning device also includes a stopper that limits the amount of movement of the indicator.

In accordance with an embodiment of the present invention, when the pitch of the input signal is extracted by the pitch extraction device and when the deviation of the pitch of the input signal from the standard pitch is detected by the deviation detection device, control of the driving of the ultrasonic motor is carried out by the control device in conformance with the deviation that has been detected by the deviation detection device.

As a result, the indicator of the mechanical meter that is driven by the ultrasonic motor moves to a position that corresponds to the deviation that has been detected by the deviation detection device. Here, in those cases where the deviation that has been detected by the deviation detection device is 0, the indicator is placed at the standard position and, at the same time, in those cases where the value of the deviation that has been detected by the deviation detection device is positive, the indicator moves to a position in the positive direction that corresponds to the deviation. While, on the other hand, in those cases where the deviation that has been detected has a negative value, the indicator moves to a position in the negative direction that corresponds to the deviation.

Therefore, since neither a spring nor an electromagnet is used for driving the indicator, there is the advantageous result that it is possible to economically reduce the display error that is produced, which has been a problem with the mechanical meters of the past and together with this, the effective life can be improved. In addition, since it is possible to reduce the variations between the individual meters by using an ultrasonic motor, it is not necessary to install a fine adjustment capability, and there is the advantageous result that the processes at the time of manufacture can be simplified. Furthermore, because the structure of an ultrasonic motor is, in general, simple, there is the advantageous result that it is possible to design for the miniaturization of the tuning device overall.

In addition, since the ultrasonic motor, which is the drive source for the indicator, is not affected by gravity or the magnetic forces in the vicinity, there is the advantageous result that there are no limitations on the placement direction or the placement angle or on the utilization location, and the usability is improved. Furthermore, since an ultrasonic motor is used as the drive source for the indicator, there is the advantageous result that it is possible for the driving to be done with reduced power consumption compared to the mechanical meters of the past that use electromagnets and, together with this, because there is no need for wiring to be in the vicinity of the indicator that rotates, it is possible to reduce the occurrence of wiring failures.

In addition, since the indicator is driven as the result of the driving of the ultrasonic motor by the control device based on the indicator position information that has been detected by the position detection device and the deviation of the pitch of the input signal from the standard pitch, there is the advantageous result that the indicator can move accurately to the position that corresponds to the deviation, and accurate tuning is possible.

Also, since the position information for the indicator is detected by the position detection device within the range of movement of the indicator, in those cases where the indicator is moved and the deviation is displayed by the indication, it is possible to obtain the position information for the indicator within the region that the deviation should be displayed. Therefore, there is the advantageous result that the deviation can accurately be displayed based on the position information for the indicator, and accurate tuning is possible.

Further, since the position information that indicates the fact that the indicator is placed at the standard position is detected by the position detection device, there is the advantageous result that in those cases where the indicator is moved and a deviation is displayed by an indication, at least a position that indicates the standard position, in other words, the fact that the deviation is zero, can always accurately be displayed and it is possible to carry out the tuning accurately.

Since the indicator is made into a single unit together with the rotating section of the ultrasonic motor, there is the advantageous result that it is possible to design for further miniaturization and making the entire tuning device thinner.

Also, since the amount of movement of the indicator is limited by a stopper section, it is possible to limit the amount of movement of the indicator to the region of the deviation that should be displayed. Therefore, there is the advantageous result that in those cases where the deviation is displayed by an indication using the indicator, it is possible for the indicator to be moved within the region of the deviation that should be displayed.

PREFERRED EMBODIMENTS OF THE INVENTION

Figure 1:
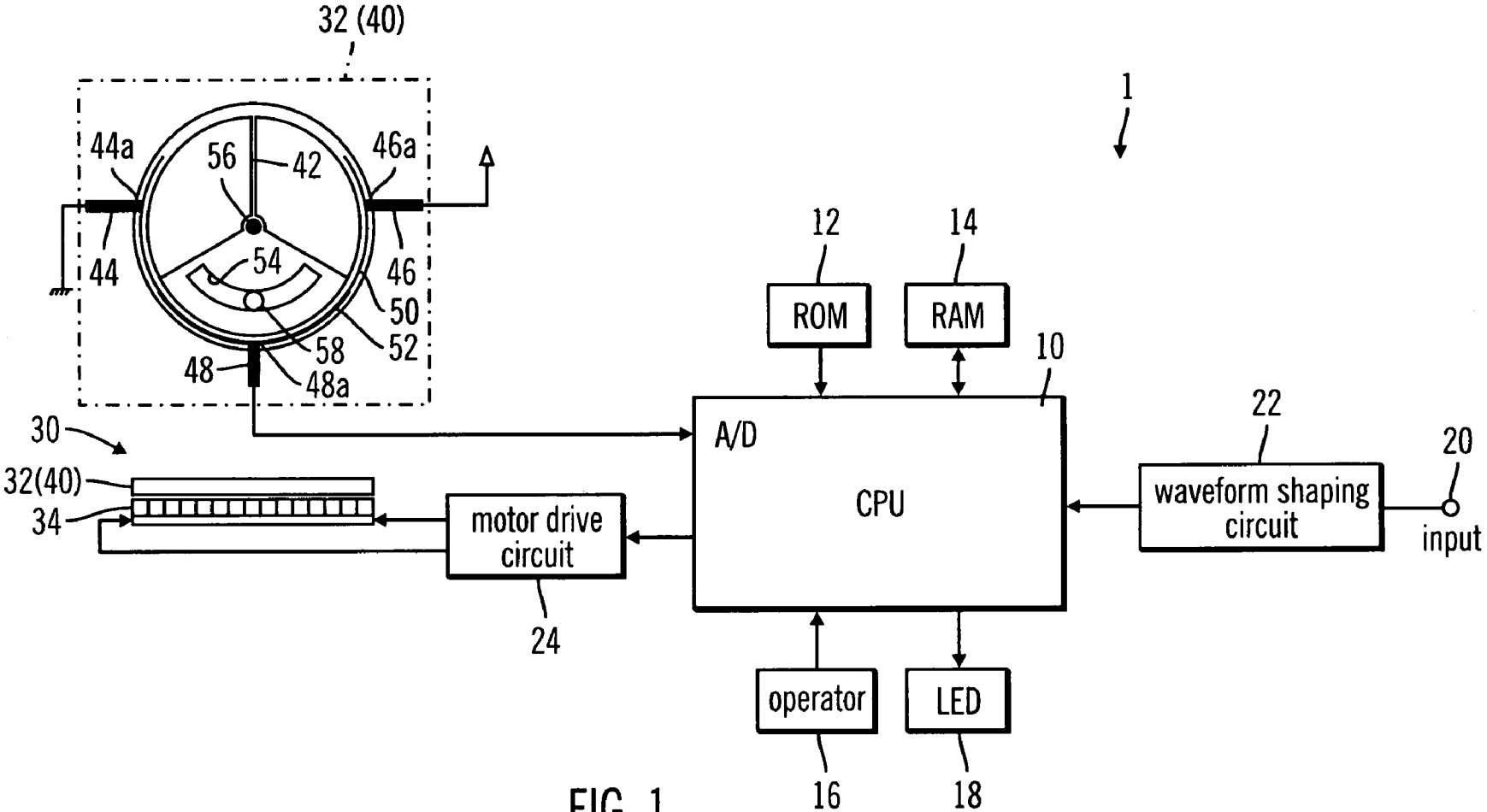
FIG. 1 is a block diagram that shows the configuration of the tuning device according to an example embodiment of the present invention.

An explanation will be given below regarding an example embodiment of the present invention while referring to the attached drawings. FIG. 1 is a block diagram that shows the configuration of the tuning device 1, which is one example embodiment of the present invention. As shown in FIG. 1, the tuning device 1 is furnished primarily with a signal input terminal 20, a waveform shaping circuit 22, which is an analog circuit that amplifies the input guitar signal that has been input from a guitar (not shown in the drawing) through the signal input terminal 20 (hereinafter, referred to simply as the "input signal") and shapes the waveform into a square wave, a (CPU) 10, a (ROM) 12, a (RAM) 14, operators 16, LEDs 18, an ultrasonic motor 30 that has a meter section 40, and a motor drive circuit 24, which is a circuit that produces the drive signal for driving the ultrasonic motor 30.

The CPU 10 is a central processing unit that controls the entire tuning device 1 and is furnished with an A/D converter, which converts the analog signal into a digital signal, and an edge interrupt terminal (not shown in the drawing), which detects the leading edge of the square wave that has been input from the waveform shaping circuit 22 and causes an interrupt to be generated.

The ROM 12 is a nonvolatile memory in which the various types of programs that are executed by the CPU 10 and the fixed value data that are referred to at the time of execution are stored. In addition, the pitch data for the standard pitches are stored in the ROM 12.

The RAM 14 is a rewritable memory that can be accessed randomly, which has a working area that includes various kinds of buffers and various kinds of registers and the like as well as temporary areas and the like in which data are stored temporarily during processing.

The operators 16 are the switches with which the various functions of the tuning device 1 are operated including the power switch (not shown in the drawing) with which the power to the tuning device 1 is switched on and off, the standard pitch setting switch (not shown in the drawing) the standard pitch to which the string that is tuned is set, and the up switch and the down switch (neither of which is shown in the drawing) with which the level of the input signal is adjusted.

The LEDs 18 display the standard pitch that has been set by the standard pitch setting switch (not shown in the drawing), which is an operator 16, by the flashing of an LED and includes eight LEDs that correspond to the seven note names (C, D, E, F, G, A, and B) for carrying out a chromatic display and "#," which is a half-tone sign (none of which is shown in the drawing).

The ultrasonic motor 30 is a motor that utilizes the elastic oscillations in the ultrasonic region from a piezoelectric element as the driving source. Here in FIG. 1, the ultrasonic motor 30 is shown in the drawing as a lateral view schematic diagram. As is shown in FIG. 1, the ultrasonic motor 30 is furnished with a stator section 34 that is equipped with a piezoelectric element (not shown in the drawing) that generates oscillations based on a two-phase drive signal (a sine wave and a cosine wave), and a rotor section 32 that is pressure connected by a pressure device (not shown in the drawing) to the drive section of the stator section 34 (the surface on the upper part of the page in FIG. 1).

When a sine wave and a cosine wave that have been output from the motor drive circuit 24 are input to the stator section 34, as a result of the oscillations that have been generated together with a traveling wave in the piezoelectric element (not shown in the drawing), the rotor 32 of the ultrasonic motor 30 is driven and rotates in a direction that is opposite that of the traveling wave around a shaft 56 due to the friction with the vibrating stator section 34. Here, the sine wave and the cosine wave that are input to the stator section 34 are generated and output by the motor drive circuit 24 in conformance with the drive information that specifies the drive direction for the ultrasonic motor 30 in accordance with the display processing that will be discussed later (refer to FIG. 3).

The details will be discussed later but in the tuning device 1 of this example embodiment, the rotation of the ultrasonic motor 30 is utilized as the drive source for the movement of an indicator 42 of a meter section 40. As was described above, since the ultrasonic motor 30 is driven based on a two-phase signal (a sine wave and a cosine wave), it is possible for the configuration of the tuning device 1 to be made without the use of a coil or a magnet and the like. Because of this, since the tuning device 1 of this example embodiment is not affected by the magnetic forces in the vicinity, the device can be used without any limitation on the place of use and it is possible to carry out accurate tuning even when the device is used near a system that generates magnetic forces such as the speaker of a guitar amp or a guitar pickup.

In addition, since in the ultrasonic motor 30, the rotor section 32 is pressure connected to the stator section 34, the holding torque is great and as a result, the display does not change, no matter in what direction or what angle the tuning device 1 is placed. Because of this, it is possible to carry out accurate tuning with the tuning device 1 without regard to the direction of placement or the angle of placement.

In addition, because the ultrasonic motor 30 is, in general, superior with regard to response and controllability, it is not likely that individual variations will occur. Therefore, by using an ultrasonic motor 30 such as this, it is possible to not require the installation of a fine adjustment capability in the tuning device 1.

In addition, since, due to the use of the ultrasonic motor 30 as the drive source for the indicator 42, neither a spring nor an electromagnet, which were used in the past, is used in order to drive the indicator 42. Thus, it is possible to economically reduce the generation of the display errors produced in the mechanical meters of the past and, together with this, the effective life can be increased.

In addition, because it is possible to drive the ultrasonic motor 30 with thrifty power consumption, by utilizing this kind of ultrasonic motor 30 as the drive source for the indicator 42, the driving can be done with less power consumption than the mechanical meters of the past that used electromagnets. Also, since it is not necessary to have wiring connected around the indicator rotated in the mechanical meters of the past, it is possible to reduce the rate of the occurrence of wiring failures.

In addition, because, in general, the structure of the ultrasonic motor 30 is simple, using the ultrasonic motor 30 as the drive source for the indicator 42, it is possible to make the overall configuration of the tuning device 1 small.

In this example embodiment, the rotor section 32 of the ultrasonic motor 30 is configured as a single unit together with the meter section 40. By making the configuration of the rotor section 32 of the ultrasonic motor 30 as a single unit together with the meter section 40 in this manner, it is possible to make the tuning device 1 overall smaller and thinner.

Incidentally, the rotor section 32 is shown in the drawing as a portion of the structure of the ultrasonic motor 30 that is shown as a lateral view schematic drawing in the lower left of FIG. 1. In addition, the meter portion 40 is shown in the drawing as a frontal view schematic drawing for the purpose of explanation on the upper left of FIG. 1. The connection between the rotor section 32 that is shown in the drawing as a portion of the ultrasonic motor 30 on the lower left of FIG. 1 and the CPU 10 has been omitted here.

The meter section 40 is furnished with the indicator 42 that rotates around the shaft 56 together with the rotation of the rotor section 32, and the display of the deviation of the pitch of the input signal from the standard pitch by the indicator 42 is through indication by a scale (not shown in the drawing).

In addition, a circular arc shaped opening section 54 is disposed in the meter section 40 with the shaft 56 as the center and a stopper 58 is fixed in the bottom surface of the stator section 34 such that the stopper passes through to the inner peripheral side of the opening section 54. With the opening section 54 and the stopper 58, it is possible to limit the amount of rotation of the rotor section 32 to the range of the arc defined by the opening section 54. In other words, the amount of rotation of the indicator 42 of the meter section 40 is limited.

The arc of the opening section 54 here is configured with a length that restricts the indicator 42 to within the range of the scale (not shown in the drawing) for the display of the deviation of the pitch of the input signal from the standard pitch. Therefore, it is set up such that the indicator 42 is moved within the range of the scale (not shown in the drawing) for the display of the deviation of the pitch of the input signal from the standard pitch. In addition, in this example embodiment, the configuration is such that with the opening section 54 and the stopper 58, the indicator 42 indicates the zero gradation on the scale that is not shown in the drawing in the position in which the restricted amount of rotation is divided into two equal parts.

In the meter section 40 (the rotor section 32), as is shown in FIG. 1, the conducting section 50 that has been formed in an arc shape and the carbon resistor 52 have been disposed as a single unit. Meanwhile, the three terminals 44, 46, and 48 are disposed on the meter section 40, and it has been configured such that these three terminals 44, 46, and 48 are connected to the conductor section 50 or the carbon resistor 52 with the tip sections of the three terminals as the sliders 44*a*, 46*a*, and 48*a*.

With this potentiometer structure, the carbon resistor 52 is configured such that up to the point where the right end of the opening section 54 of the meter section 40 is in contact with the stopper 58, in other words, in those cases where the rotation is the maximum in the clockwise direction, one end is in contact with the slider 44*a* and the other end is in contact with the slider 48*a*. On the other hand, up to the point where the left end of the opening section 54 of the meter section 40 is in contact with the stopper 58, in other words, in those cases where the rotation is the maximum in the counterclockwise direction, the configuration is such that one end of the resistor is in contact with the slider 48*a* and the other end is in contact with the slider 46*a*.

In addition, a positive voltage (in this example embodiment, it is 3 V) is applied to the terminal 46 that is connected to the slider 46*a* when the power is turned on and, on the other hand, the terminal 44 which is connected to the slider 44*a* is grounded.

In other words, in the meter section 40, the position of the slider 48*a* that is in contact with the carbon resistor 52 varies together with the rotation and, as a result, meter section 40 have a potentiometer structure such that the voltage values between the terminal 44 and the terminal 48 and between the terminal 48 and the terminal 46 are variable. Because of this, in the meter section 40, when in accordance with the rotation, the left end of the opening section 54 is at a position in contact with the stopper 58, the voltage value that is output from the terminal 48 is at the minimum (0 V). On the other hand, when the right end of the opening section 54 is positioned in contact with the stopper 58, the voltage value that is output from the terminal 48 is at the maximum (in this example embodiment, it is 3 V).

Therefore, in those cases where the indicator 42 indicates a minimum value (the gradation on the left end) on the scale (not shown in the drawing) for the display of the deviation of the pitch of the input signal from the standard pitch, the voltage value that is output from the terminal 48 is at the minimum. As the value of the gradation that is indicated by the indicator 42 becomes greater, the voltage value that is output from the terminal 48 increases. In addition, in those cases where the indicator 42 indicates a maximum value (the gradation on the right end), the voltage value that is output from the terminal 48 is at the maximum.

Accordingly, by referring to the voltage value that is output from the terminal 48, it is possible to obtain the position information related to the position at which the indicator 42 is placed within the range of movement of the indicator, in other words, what position on the scale (not shown in the drawing) for the display of the deviation of the pitch of the input signal from the standard pitch is indicated by the indicator 42. Since by referring to the voltage value that is output from the terminal 48 in this manner, it is possible to ascertain the position of the indicator 42 within the range of movement, and as a result, accurate tuning can be carried out with the tuning device 1.

Here, in this example embodiment, with the potentiometer structure of the meter section 40, it is configured such that the slider 48*a* is in contact with roughly the center of the carbon resistor 52 in the position in which the amount of rotation of the indicator 42 of the meter section 40, which is limited by the opening section 54 and the stopper 58, is divided into two equal parts. Therefore, in the tuning device 1 of this example embodiment, when the voltage value that is output from the terminal 48 is one half the voltage that has been applied between the terminal 44 and the terminal 46 (in this example embodiment, this is +1.5 V), the indicator 42 indicates the zero gradation.

Accordingly, with the tuning device 1 of this example embodiment, it is possible to obtain the position information that indicates whether or not the indicator 42 is at a position in which the deviation of the pitch of the input signal from the standard pitch is zero, in other words, whether or not the indicator 42 is placed at the zero gradation, which is the standard position for the tuning, by referring to the voltage value that is output from the terminal 48. Since it is possible in this manner to always accurately ascertain the standard position for the indicator 42 by the voltage value that is output from the terminal 48, the result is that accurate tuning can be carried out with the tuning device 1.

With regard to the specific processing, this will be discussed later while referring to FIG. 2 and FIG. 3, but with the tuning device 1 that has been configured as described above, when the input signal is input from the signal input terminal 20, the input signal is shaped into a square wave by the waveform shaping circuit 22 and output to the CPU 10 and the pitch of the input signal is acquired by the processing by the CPU 10. On the other hand, when the voltage value that has been output from the terminal 48 of the meter section 40, which has been made into a single unit with the rotor section 32 of the ultrasonic motor 30, is input to the CPU 10, the position information for the indicator 42 is acquired.

As a result of the execution of the display processing (refer to FIG. 3), the CPU 10 outputs the drive information based on the deviation of the pitch of the input signal from the standard pitch and the position information for the indicator 42 to the motor drive circuit 24, and the motor drive circuit 24 outputs a drive signal based on the drive information to the stator section 34 of the ultrasonic motor 30. As a result, the rotor section 32 of the ultrasonic motor 30 rotates and the indicator 42 in the meter section 40, which has been made as a single unit with the rotor section 32, moves.

In addition, as a result of the execution of the display processing (refer to FIG. 3), the CPU 10 outputs a drive information to the motor drive circuit 24 until the position information for the indicator 42, which is acquired based on the voltage value that has been output from the terminal 48, reaches the amount that corresponds to the deviation of the pitch of the input signal from the standard signal and the indicator 42 moves up to the position that corresponds to that deviation.

Next, an explanation will be given regarding the specific processing that is executed in a tuning device 1 as has been described above while referring to FIG. 2 and FIG. 3. FIG. 2 is a flowchart that shows the main processing that is executed by the tuning device 1 and is launched when the power to the tuning device 1 is turned on and that is repeatedly executed by the CPU 10 during the time that the power is left on.

Figure 2:
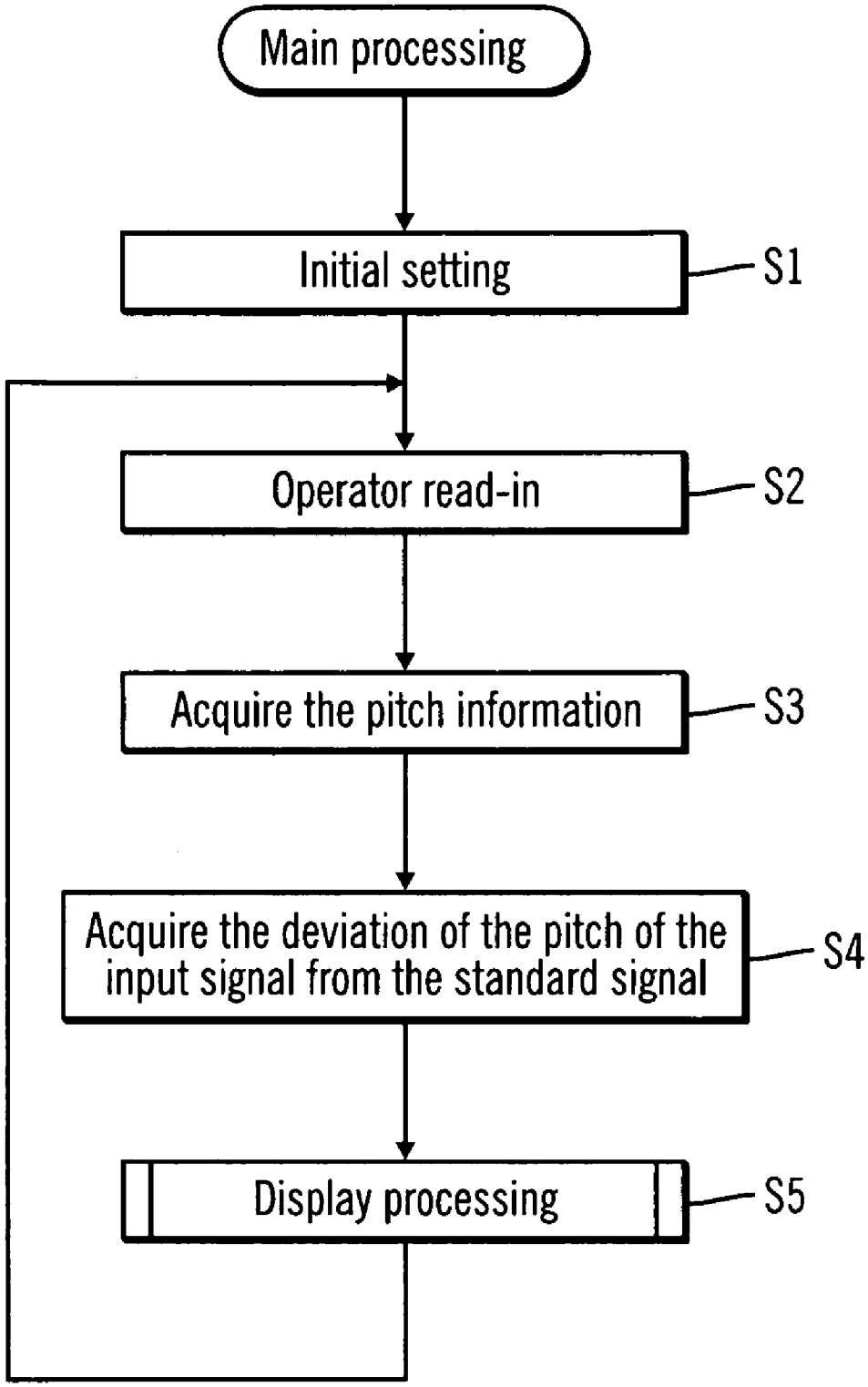
FIG. 2 is a flowchart that shows the main processing that is executed by the tuning device according to an embodiment of the present invention.
Figure 3:
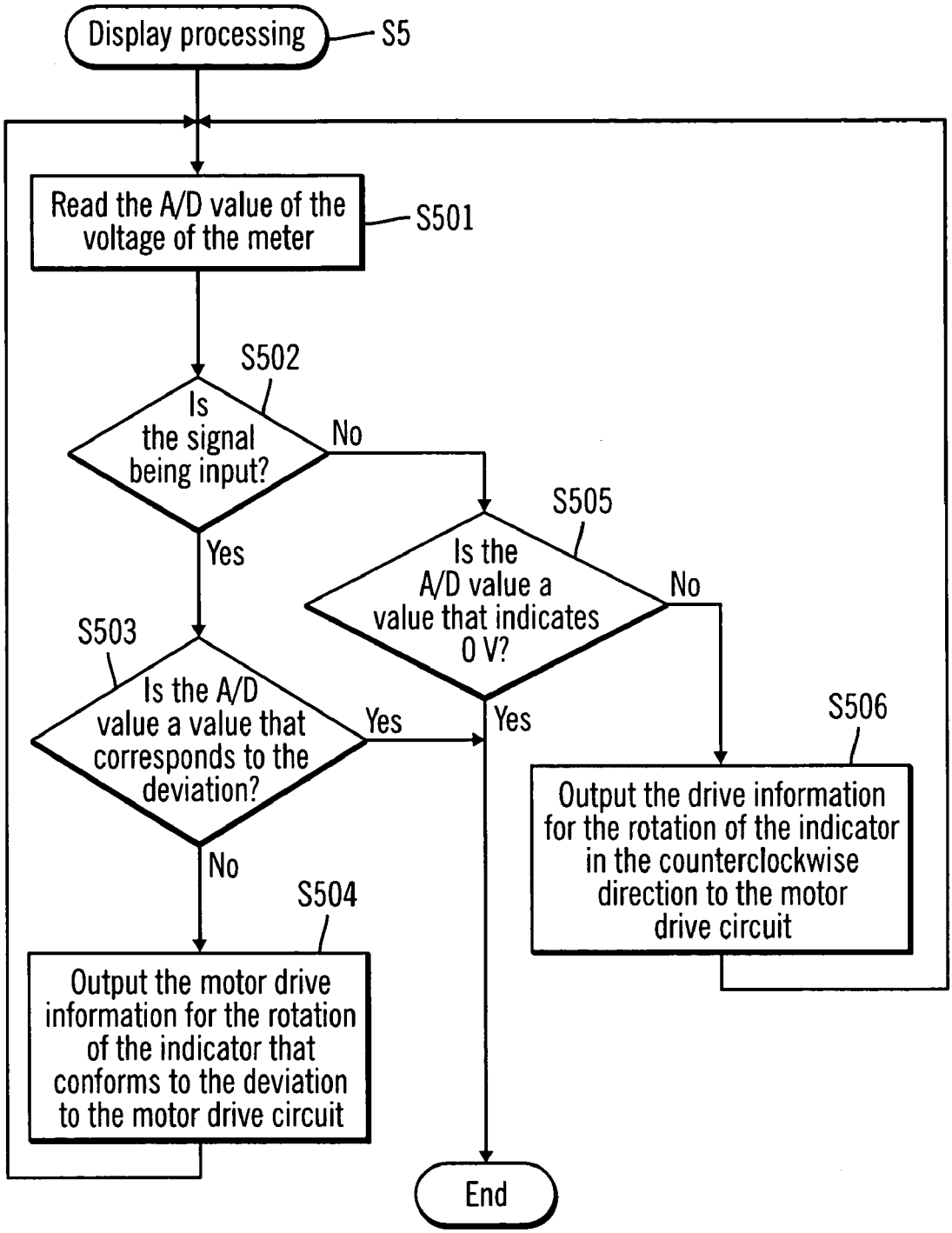
FIG. 3 is a flowchart that shows the display processing according to an embodiment of the present invention.

As is shown in FIG. 2, in the main processing, first the initial setting is carried out (S1). In the initial setting (S1), the initial values are set for the various types of buffers, the various types of registers, and the various types of parameters that are used in the main routine. In addition, the drive information is output to the motor drive circuit 24, and the meter section 40 is rotated in the counterclockwise direction until the left end of the opening section 54 comes into contact with the stopper 58.

Following the processing of S1, the setting states of the operators 16 (the standard pitch setting switch, the Up switch, the Down switch, and the like) are read out and the settings of the corresponding registers and the like are carried out in conformance with each of the setting states of the operators 16 (S2). As a result of the processing of S2, the setting of the standard pitch that is to be referred to is accomplished.

Following the processing of S2, the pitch of the input signal is extracted and the pitch information is acquired (S3). Since the processing of S3 is technology that is commonly known to one skilled in the art, a detailed explanation has been omitted. When the leading edge of the square wave that has been input from the waveform shaping circuit 22 is detected by the edge interrupt terminal (not shown in the drawing) of the CPU 10, however, counting is begun by the counter of the CPU 10, the time period of one cycle of the square wave until the next leading edge is calculated by a routine that is not shown in the drawing, and the value that has been calculated is acquired as the pitch information.

Next, the deviation of the pitch of the input signal based on the pitch information that has been acquired by the processing of S3 from the standard pitch that has been set by the processing of S2 is acquired (S4). The display processing, which will be discussed later while referring to FIG. 3, is executed (S5), and the deviation that has been acquired by the processing of S4 is displayed by an indication on the scale (not shown in the drawing) by the indicator 42 of the meter section 40.

Then, following the execution of the display processing (S5), the routine shifts to the processing of S2 and the processing of S2 through S5 is repeated until the power to the tuning device 1 is turned off by the operation of the power switch (not shown in the drawing), which is an operator 16.

Next, an explanation will be given regarding the display processing described above (S5) while referring to FIG. 3. FIG. 3 is a flowchart that shows the display processing (S5). As is shown in FIG. 3, in the display processing (S5), first, the position information for the indicator 42 is obtained by the reading of the A/D value of the voltage at the terminal 48 of the meter section 40 (S501). Incidentally, in the processing of S501, in those cases where the A/D value of the voltage at the terminal 48 is a value that corresponds to a value that has exceeded +3 V, the A/D value is adjusted to a value that corresponds to +3 V. On the other hand, in those cases where the value corresponds to a value less than 0 V, the A/D value is adjusted to a value that corresponds to 0 V.

Following the processing of S501, whether the guitar signal is-being input to the signal input terminal 10 is ascertained (S502) and, if the guitar signal is being input (S502: yes), whether the A/D value of the output voltage at the terminal 48 that has been read by the processing of S501 is a value that corresponds to the deviation that has been obtained by the processing of S4 is ascertained (S503).

If the result that has been ascertained by the processing of S503 is that the A/D value of the output voltage at the terminal 48 is not a value that corresponds to the deviation that has been obtained by the processing of S4 (S503: no), the drive information that is needed for the indicator to be rotated in conformance with the deviation is output to the motor drive circuit 24 (S504) and the routine shifts to the processing of S501.

When the drive information is output to the motor drive circuit 24 by the No branch processing in S503 and the processing of S504, the drive signal (a sine wave and a cosine wave) that is needed for the rotor section 32 of the ultrasonic motor 30 to be rotated clockwise is output to the stator section 34 of the ultrasonic motor 30 from the motor drive circuit 24. As a result, the rotor section 32 is rotated and the indicator 42 is moved toward the gradation (not shown in the drawing) that corresponds to the deviation of the pitch of the input signal that has been obtained by the processing of S4 from the standard pitch.

On the other hand, if the result that has been ascertained by the processing of S503 is that the A/D value of the output voltage at the terminal 48 is a value that corresponds to the deviation that has been obtained by the processing of S4 (S503: yes), the display processing (S5) ends.

The state in which the deviation that has been acquired by the processing of S4 is indicated by the indicator 42 is terminated as a result of the Yes branch processing in S503. Accordingly, during the input of the guitar signal to the signal input terminal 10, the indicator 42 is rotated in conformance with the deviation of the pitch of the input signal from the standard pitch and moved until the indicator 42 arrives at the gradation (not shown in the drawing) that corresponds to the deviation by the processing of S501 through S504. As a result of that, the deviation of the pitch of the input signal from the standard pitch is communicated to the user visually.

As described above, the tuning device 1 of this example embodiment, is configured such that in those cases where the deviation of the pitch of the input signal from the standard pitch is zero, a voltage of +1.5 V is output from the terminal 48. Therefore, in those cases where, for example, the deviation that has been acquired by the processing of S4 is zero, the indicator 42 is moved toward the zero gradation by the No branch processing in S503 and the processing of S504 until an A/D value that indicates that the terminal 48 is +1.5 V is detected in S501. Then, when an A/D value that indicates that the terminal 48 is +1.5 V is detected in S501, the indicator 42 stops at the zero gradation due to the No branch processing in S503.

In addition, if the result that has been ascertained by the processing of S502 is that the guitar signal is not being input (S502: no), whether the A/D value of the output voltage at the terminal 48 is a value that indicates 0 V is ascertained (S505). Also, if the value is not one that indicates 0 V (S505: no), the drive information that is needed for the indicator to be rotated in the counterclockwise direction is output to the motor drive circuit 24 (S506) and the routine shifts to the processing of S501.

When the drive information is output to the motor drive circuit 24 by the processing of S506, the drive signal (a sine wave and a cosine wave) that is needed for the rotor section 32 of the ultrasonic motor 30 to be rotated counterclockwise is output to the stator section 34 of the ultrasonic motor 30 from the motor drive circuit 24. As a result, the rotor section 32 is rotated and together with this, the indicator 42 is rotated counterclockwise.

On the other hand, if the result that has been ascertained by the processing of S505 is that the A/D value of the output voltage at the terminal 48 is a value that indicates 0 V (S505: yes), the display processing (S5) ends.

Therefore, in those cases where the guitar signal is not being input to the signal input terminal 20, by the processing of S502, S505, and S506, the indicator 42 is rotated in the counterclockwise direction and stops at the gradation of the minimum value (the gradation that is on the left end).

In the display processing (S5), since the position information for the indicator 42 is acquired by referring to the A/D value of the voltage at the terminal 48 of the meter section 40, it is possible to accurately move the indicator 42 in conformance with the deviation; and, as a result, accurate tuning can be carried out.

As has been explained above, in accordance with the tuning device 1 of this example embodiment, the indicator 42 of the meter section 40 is driven by the ultrasonic motor 30. Therefore, since neither the spring nor the electromagnet that were employed in the past is used for driving the indicator 42, it is possible to economically reduce the occurrence of the display errors that were a problem with the mechanical meters of the past and, together with this, the expected life can be increased. In addition, it is possible to reduce the individual meter variations by the use of an ultrasonic motor as the drive source for the indicator 42, and it is not necessary to install a fine adjustment capability. As a result, the processes at the time of manufacture can be simplified.

In addition, since the ultrasonic motor 30, which is the drive source for the indicator 42, is not affected by gravity or by the magnetic forces in the vicinity, the direction of placement and the angle of placement, as well as the usage locations are not limited and the usability of the tuning device 1 is improved. Furthermore, since the ultrasonic motor 30 is used as the drive source for the indicator 42, the driving can be done with less consumption of power than with the mechanical meters of the past that employed an electromagnet and, in addition, because there is no need for the wiring to be connected around the indicator 42, which rotates, it is possible to reduce the rate of occurrence of wiring failures.

In addition, since the meter section 40, which includes the indicator 42 is made in a single unit together with the rotor section 32 of the ultrasonic motor 30, it is possible for the overall configuration of the tuning device 1 to be small and thin.

Incidentally, with regard to the pitch extraction device, the processing of S3 in the main processing of FIG. 2 corresponds to this, with regard to the deviation detection processing, the processing of S4 in the main processing of FIG. 2 corresponds to this, and with regard to the control device, the display processing (S5) of FIG. 5 corresponds to this.

An explanation was given above regarding the present invention based on example embodiments but the present invention is not in any way limited to the example embodiments that have been discussed above and the possibility of various modifications and changes that do not diverge from and are within the scope of the tenor and purport of the present invention can be easily surmised.

For example, in the example embodiments described above, it has been set up such that the current position of the indicator 42 is detected continuously using the carbon resistor 52 that has been formed in an arc shape that corresponds to the range in which the indicator 42 moves. However, the current position of the indicator 42 may be established using sensors such as infrared sensors or optical sensors disposed in one location or a plurality of locations in the range in which the indicator 42 moves such that control is done by the detection of the fact that the indicator 42 has passed the position at which one of the sensors has been disposed.

Incidentally, it is preferable that a sensor (an infrared sensor, or an optical sensor and the like), with which the position of the indicator 42 is detected, be disposed in a location in which it is possible to detect the position that indicates the fact that the deviation is zero (the standard position). Since, by the arrangement of a sensor in this manner, at a minimum, the standard position can be accurately detected, accurate tuning becomes possible.

In addition, in the example embodiments described above, it is configured such that the position information for the indicator 42 is acquired based on the voltage value that is output from the terminal 48 and the amount of movement of the indicator 42 is controlled by the feedback control feature using the position information. As a substitute for this kind of feedback control, it may be configured such that in the initial settings that are executed at the time that the power is turned on (S1 in the main processing of FIG. 1), the initial position of the indicator 42 is reset to a position in which the indicator 42 is rotated to the position where the left end of the opening section 54 comes into contact with the stopper 58, the amount of rotation of the rotor section 32 from the reset position to the deviation is derived by calculating conformance with the deviation of the pitch of the input signal from the standard pitch, and a drive signal that conforms to that amount is output from the motor drive circuit 24.

In addition, in the example embodiments described above, it has been configured such that a drive signal (a sine wave and a cosine wave) that has been produced by the motor drive circuit 24 is output to the ultrasonic motor 30 and, by this, the ultrasonic motor 30 is driven. However, as a substitute for the motor drive circuit 24, it may also be configured such that a square wave is produced by the CPU 10, and a drive signal that resembles a sine wave and a cosine wave is produced by a CR integrating circuit and output to the ultrasonic motor 30.

In addition, in the example embodiments described above, it has been configured such that the rotor section 32 of the ultrasonic motor 30 and the meter section 40 are made in a single unit but the configuration is not limited only to this and it may also be configured such that the rotation from the ultrasonic motor 30 is transmitted by a gear and the indicator 42 is moved.

In addition, in the example embodiments described above, an explanation was given in which the input signal that is input from the signal input terminal 20 is a guitar signal. This input the signal is not limited to this. A signal may also be input from another musical instrument like a wind instrument or a string instrument, or a microphone and the like.

In addition, in the example embodiments described above, an explanation was given in which the standard pitch stetting is set by the operation of the standard pitch setting switch by the user. However, the standard pitch setting may be set up as has been common knowledge for some time to one skilled in the art such that a pitch notation that is closest to the detected pitch is selected by the CPU 10 and is set as the standard pitch.

What is claimed is:

1. A tuning device, comprising:

pitch extraction means with which a pitch of an input signal is extracted;

deviation detection means with which a deviation of the pitch that has been extracted by the pitch extraction means from a standard pitch is detected, and the deviation that has been detected by the deviation detection means is displayed by an indicator of a mechanical meter;

an ultrasonic motor that drives the indicator; and control means that drives the ultrasonic motor in conformance with the deviation that has been detected by the deviation detection means, wherein the control means, by driving of the indicator using the ultrasonic motor, arranges the indicator in a standard position when the deviation that has been detected by the deviation detection means is zero, and moves the indicator up to a position in a positive direction that corresponds to the deviation when the deviation is a positive value, and moves the indicator up to a position in a negative direction that corresponds to the deviation when the deviation is a negative value.

2. The tuning device according to claim 1, further comprising position detection means with which position information of the indicator is detected, and the control means drives the ultrasonic motor based on the position information of the indicator detected by the position detection means and the deviation.

3. The tuning device according to claim 2, wherein the position detection means is one in which the indicator position information is detected in a range in which the indicator moves.

4. The tuning device according to claim 2, wherein the position detection means is one that detects the position information that indicates that the indicator is arranged at the standard position.

5. The tuning device according to claim 1, wherein the indicator is made in a single unit together with a rotating section of the ultrasonic motor.

6. The tuning device according to claim 1, further comprising a stopper that limits an amount of movement of the indicator.

7. The tuning device according to claim 1, wherein the control means comprises a motor drive circuit.

8. The tuning device according to claim 7, wherein the motor drive circuit can generate a signal independent of an input signal.

9. The tuning device according to claim 7, wherein the motor drive circuit can generate a signal independent of the pitch deviation.

10. The tuning device according to claim 1, wherein the control means outputs a periodic signal that is comprised of at least one sinusoidal waveform.

11. The tuning device according to claim 1, wherein the control means does not extract a deviation of the pitch.

12. The tuning device according to claim 1, wherein the deviation detection means continuously operates in real time to detect a plurality of deviations and the indicator continuously displays the deviations in real time.

13. The tuning device according to claim 1, wherein the control means arranges the indicator in a standard position by providing a drive signal to drive the ultrasonic motor to move the indicator to the standard position.

14. The tuning device according to claim 1, wherein the indicator is configured to provide an electrical output signal corresponding to the indicator's position.

15. A tuning device, comprising:

an indicator of a mechanical meter that displays a pitch deviation of a pitch of an input signal from a standard pitch;

an ultrasonic motor that drives the indicator; and a controller that drives the ultrasonic motor in conformance with the pitch deviation and arranges the indicator in a standard position when the pitch deviation is zero, and moves the indicator in a positive direction when the pitch deviation is a positive value, and moves the indicator in a negative direction when the pitch deviation is a negative value.

16. The tuning device according to claim 15, further comprising an extracting device to extract the pitch of the input signal.

17. The tuning device according to claim 15, further comprising a position detection device with which position information of the indicator is detected, and the controller drives the ultrasonic motor based on the position information of the indicator detected by the position detection device and the pitch deviation.

18. The tuning device according to claim 17, wherein the position detection device is one in which the indicator position information is detected in a range in which the indicator moves.

19. The tuning device according to claim 17, wherein the position detection device is one that detects the position information that indicates that the indicator is arranged at the standard position.

20. The tuning device according to claim 15 wherein the indicator is made in a single unit together with a rotating section of the ultrasonic motor.

21. The tuning device according to claim 15, further comprising a stopper that limits an amount of movement of the indicator.

22. The tuning device according to claim 15 wherein:

the indicator continuously displays a plurality of pitch deviations, wherein each deviation corresponds to a pitch of an input signal from a standard pitch; and the controller drives the ultrasonic motor in conformance with the plurality of pitch deviations and for each pitch deviation arranges the indicator in a standard position when the pitch deviation is zero, and moves the indicator in a positive direction when the pitch deviation is a positive value, and moves the indicator in a negative direction when the pitch deviation is a negative value.

23. The tuning device according to claim 15, wherein the controller arranges the indicator in a standard position by providing a drive signal to drive the ultrasonic motor to move the indicator to the standard position.

24. The tuning device according to claim 15, wherein the indicator is configured to provide an electrical output signal corresponding to the indicator's position.

25. A method for tuning a musical instrument, comprising:

detecting a pitch deviation of a pitch of an input signal from a standard pitch;

displaying the pitch deviation using an indicator of a mechanical meter;

driving the indicator by an ultrasonic motor;

driving the ultrasonic motor in conformance with the pitch deviation;

arranging the indicator in a standard position when the pitch deviation is zero;

moving the indicator in a positive direction when the pitch deviation is a positive value; and moving the indicator in a negative direction when the pitch deviation is a negative value.

26. The method for tuning a musical instrument according to claim 25 further comprising extracting the pitch of the input signal from a musical instrument.

27. The method for tuning a musical instrument according to claim 25 further comprising:

detecting position information of the indicator; and driving the ultrasonic motor based on the detected position information of the indicator and the pitch deviation.

28. The method for tuning a musical instrument according to claim 27 further comprising detecting the indicator position information in a range in which the indicator moves.

29. The method for tuning a musical instrument according to claim 27, further comprising detecting the position information that indicates that the indicator is arranged at the standard position.

30. The method for tuning a musical instrument according to claim 25, further comprising limiting an amount of movement of the indicator.

31. A method according to claim 25 wherein:

detecting comprises continuously detecting a plurality of pitch deviations, wherein each deviation corresponds to a pitch of an input signal from a standard pitch; and displaying comprises continuously displaying the pitch deviations using an indicator of a mechanical meter.

32. A method according to claim 25 wherein the arranging of the indicator in a standard position comprises providing a drive signal to drive the ultrasonic motor to move the indicator to the standard position.

33. A method according to claim 25 further comprising providing an electrical output signal from the indicator corresponding to the indicator's position.

34. An electric instrument, comprising:

a plurality of strings;

an extracting device with which a pitch of an input signal created by the plurality of strings is extracted;

an indicator of a mechanical meter that displays a pitch deviation of the pitch of the input signal from a standard pitch;

an ultrasonic motor that drives the indicator; and a controller that drives the ultrasonic motor in conformance with the pitch deviation and arranges the indicator in a standard position when the pitch deviation is zero, and moves the indicator in a positive direction when the pitch deviation is a positive value, and moves the indicator in a negative direction when the pitch deviation is a negative value.

35. An electric instrument according to claim 34 wherein:

the extracting device is configured to continuously extract a plurality of pitches, each pitch corresponding to an input signal created by the plurality of stings; and the indicator continuously displays a plurality of pitch deviations wherein each pitch deviation shows the pitch deviation of the pitch of the input signal from a standard pitch.

36. An electric instrument according to claim 34 wherein the controller arranges the indicator in a standard position by providing a drive signal to drive the ultrasonic motor to move the indicator to the standard position.

37. An electric instrument according to claim 34, wherein the indicator is configured to provide an electrical output signal corresponding to the indicator's position.

* * * * *